United States Patent [19]

Finze

[11] 4,306,867

[45] Dec. 22, 1981

[54] APPARATUS FOR INCREASING THE REARWARD PROPULSION OF BOAT MOTORS PROVIDED WITH REVERSE GEARS

[76] Inventor: Fritz-Johann Finze, Stader Landstrasse 32, 2820 Bremen 77, Fed. Rep. of Germany

[21] Appl. No.: 112,438

[22] Filed: Jan. 16, 1980

[30] Foreign Application Priority Data

Jan. 22, 1979 [DE] Fed. Rep. of Germany ..... 2902329
Mar. 26, 1979 [DE] Fed. Rep. of Germany ..... 2911846

[51] Int. Cl.[3] ..... B63H 1/20
[52] U.S. Cl. ..... 440/49; 416/93 A; 440/89
[58] Field of Search ..... 440/49, 89, 88; 416/93 R, 93 A

[56] References Cited

U.S. PATENT DOCUMENTS 3,871,324 3/1975 Snyder ..... 440/89

*Primary Examiner*—Frank Sever
*Attorney, Agent, or Firm*—Wood, Herron & Evans

[57] ABSTRACT

The invention relates to an accessory for outboard motors, Z-drives for boats or the like, the exhaust gas of which is normally conducted through the propeller hub into the water. By means of a valve system, which is suitably automatically changed over by the direction of rotation of the propeller, the exhaust gas, during rearward rotation of the propeller, is conducted to a region which lies outside the propeller suction, while the exhaust gas, during forward rotation of the propeller, flows out in the usual manner through the propeller hub. The success of the invention lies in a significant increase of the propeller propulsion during rearward travel.

25 Claims, 6 Drawing Figures

APPARATUS FOR INCREASING THE REARWARD PROPULSION OF BOAT MOTORS PROVIDED WITH REVERSE GEARS

The invention relates to a device for increasing the rearward propulsion of boat motors provided with reverse gears, in which the axially directed exhaust passage extends through the propeller hub and in which the exhaust system has a compensating opening or the like disposed outside the vicinity of the propeller hub.

Outboard motors and so-called Z-drives for boats are provided with an underwater exhaust for reducing noise nuisance and for environment protection reasons. Since it is desirable to make the position of the exhaust outlet as deep as possible, the exhaust passage, in very many motor types, is extended through the propeller hub. The desired object is in this way optimally achieved, and also the reaction force of the exhaust gas is thereby converted into additional forward propulsion.

In very small outboard motors, such exhaust gas guidance is problem-free, since in these cases the reversal of the boat from forward travel to reverse travel is effected by a 180° rotation of the entire motor about its vertical axis. Relative to the propeller, the exhaust flow would thus always be "rearward", i.e. opposite to the direction of travel and the flow of water against the propeller would not be affected.

Outboard motors above a certain size and Z-drives are provided with a reverse gear, by means of which the direction of rotation of the propeller is reversed from forward travel to rearward travel. In these cases, the otherwise optimum guidance of the exhaust gases through the propeller hub is associated with a very unacceptable problem: while the exhaust gas stream, during forward travel of the boat, flows outwardly in the region behind the operating propeller and does not hinder the flow of water against the propeller, after the reversal there is a partly extraordinarily strong hinderance. In this case, more particularly, the exhaust gas flows into that region of the water which is sucked by the propeller for producing the rearward propulsion. This water is permeated by exhaust bubbles and is strongly turbulent. The consequence, even at low propeller speeds of rotation, is a rearward propulsion which is clearly reduced with respect to the forward propulsion. Whereas the curve of the forward propulsion, for increasing speeds of rotation, is substantially constantly inclined, it flattens dramatically at medium speeds of rotation for rearward propulsion and then remains substantially constant or even decreases.

Motor manufacturers have hitherto met this problem by building into the motors a speed limit for rearward travel. The available rearward propulsion is thereby not increased, but nevertheless it is ensured that the motors do not run at excessive speeds and cannot be damaged.

It is apparent that it is not only technically unsatisfactory, but also practically unsatisfactory, when a motor drive with a maximum forward propulsion of, for example, 123 Kp provides a maximum rearward propulsion of only approximately 48 Kp. Such small values can decisively affect the maneuverability.

A solution of this problem associated in known manner with hub exhaust was previously unknown. The invention is therefore based on the problem of providing a device for the initially mentioned boat drives which substantially increases the rearward propulsion in contrast to the state of the art.

As a solution to this problem it is proposed that, in the exhaust passage in the vicinity of the propeller shaft a valve arrangement is fixed and is movable between a closed position, in which an exhaust gas through flow is interrupted, and a release position in which it leaves free at least a substantial part of the cross-section of the exhaust duct; and that, as a drive for changing-over of the valve arrangement on changeover of the direction of rotation of the propeller, at least one drive member is provided and is exposed to the water.

Some preferred development possibilities of this inventive concept are summarized in the sub-claims.

The success achieved is unexpectedly great. In the above-mentioned example of the propulsion forces during forward and rearward travel, an outboard motor was investigated, which had a hub exhaust and the speed of which was limited to 3,000 rotations per minute during rearward travel. At 3,000 rotations per minute, this motor, in its stock form, provided a forward propulsion of 87 Kp and a rearward propulsion of 45 Kp. After incorporation of a valve means and reversing means embodying the invention, into the otherwise unaltered motor, a forward propulsion of 87 Kp was measured at 3,000 rotations per minute and the rearward propulsion had increased from the original 45 Kp to 80 Kp. An increase of the speed of rotation was not possible due to the built-in speed limit. However, the curve of the rearward propulsion for the modified motor, at the limit of the permissible rearward speed, still had a clearly increasing tendency, whereas the same curve of the stock motor still had a clearly falling tendency. Thus, by incorporation of the valve means and reversing means embodying the invention, an increase in the rearward propulsion of approximately 90% had been obtained. In another motor which was tested, an increase of the rearward propulsion of 350% was measured.

This solution is noteworthy not only in that this extreme increase in the rearward propulsion is obtained to values which approach those of forward propulsion at the same motor speed, but also in that this result is obtainable with very simple and inexpensive means.

The present system has the result that the effective gas opening during rearward travel is less deep, inasmuch as the compensating opening of the exhaust system, which is in any case present and necessary, is not located at a deep position, as is hitherto customary. However, this disadvantage has no practical significance, since the noise increase is not excessive and, above all, since the rearward operation is necessary only comparatively seldom, and even then only for brief moments, during which a correspondingly brief increase of the noise level is gladly accepted in view of the greatly increased rearward propulsion.

The invention is described in greater detail hereinafter with reference to the accompanying drawings, in which.

Figure 1:
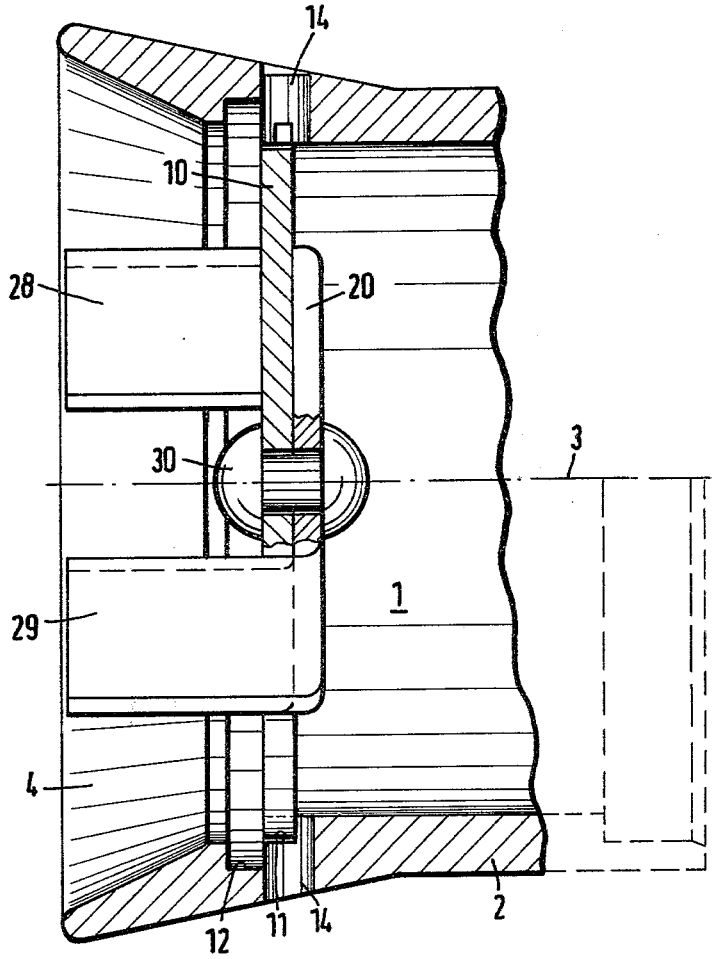
FIG. 1 shows a longitudinal section through the free end of an exhaust passage extending through a propeller.
Figure 5:
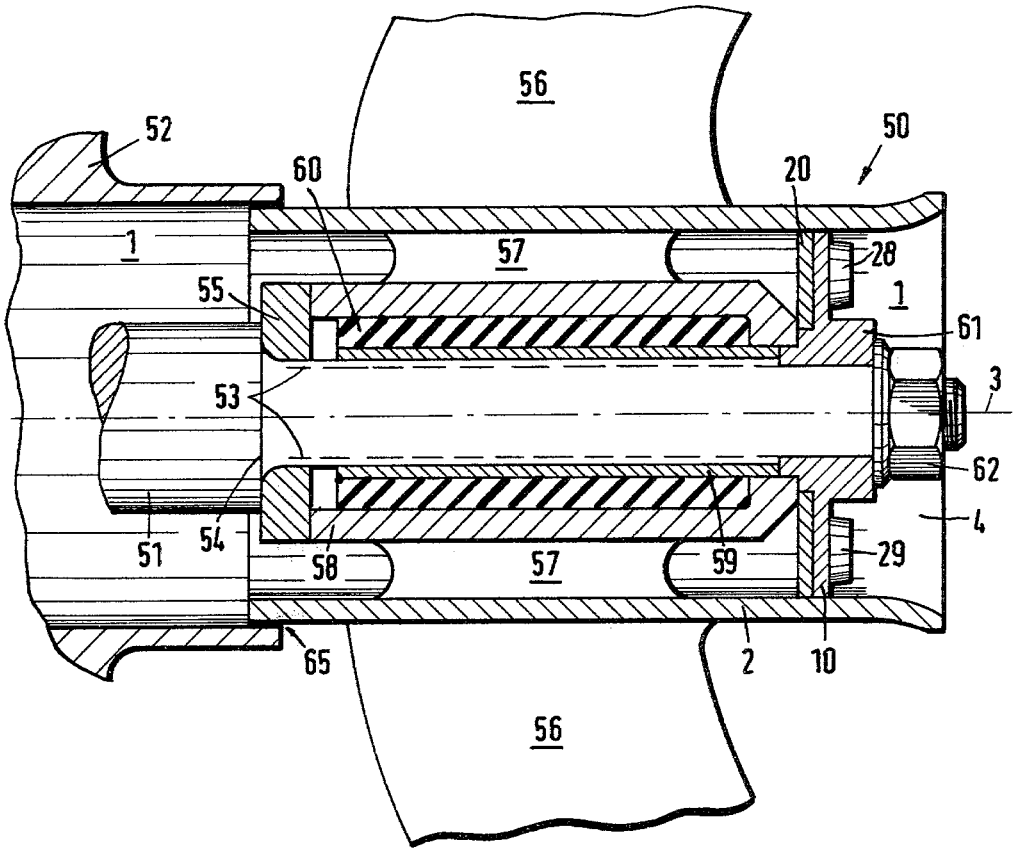
FIG. 5 shows a partial longitudinal section through a modified embodiment of the invention.

In FIG. 1 can be seen an exhaust passage 1, which extends through a tubular, outwardly divergent hub 2. It is not shown in FIG. 1 that this hub 2 carries, in known manner and analogous to FIG. 5, the blades of a propeller serving for driving and has in its interior a retainer by means of which it can be connected to the propeller shaft for rotation therewith. In the right-hand lower part of FIG. 1, it is shown in broken lines that the hub 2 can alternatively be constructed as a so-called jet ring or as a hub extension of the propeller and be so fitted onto the rear free end of the propeller, and there secured, that the axis of the hub coincides with the axis of the propeller shaft and the exhaust passage 1 shown in FIG. 1 axially extends the exhaust passage extending through the propeller. Whether the hub 2 is formed as an integral component of the propeller or as an extension or addition to a propeller depends, for example, on whether an existing propeller is to be retrofitted with the valve arrangement described hereinafter and a construction as shown in FIG. 5 does not come into the question.

Figure 3:
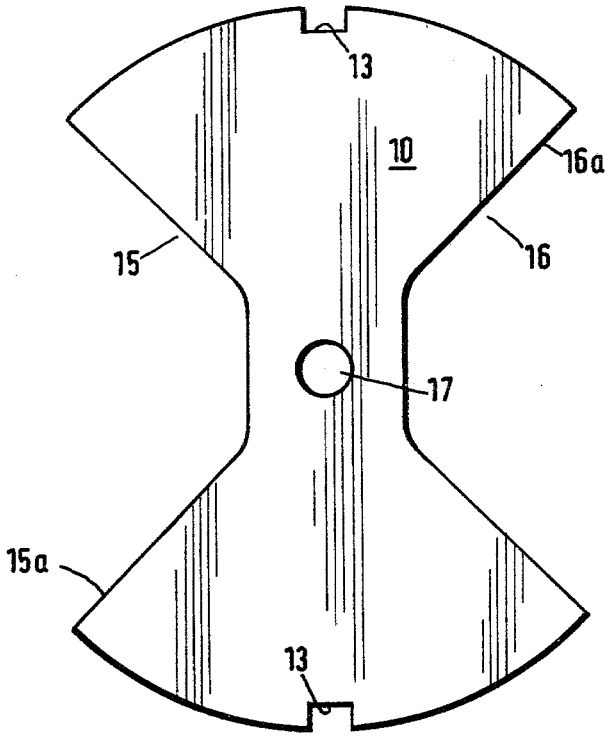
FIG. 3 shows a view in elevation of the stationary part of a valve arrangement provided in the exhaust passage.

The exhaust passage 1 can be closed by a valve arrangement, which in the illustrated embodiment is located immediately in front of its free end. This valve arrangement, in the case of the illustrated embodiments, comprises a sector shutter 10 and a closure plate 20. The sector shutter 10 (FIG. 3) is inserted into an annular groove 11 in the hub 2. This sector shutter 10 is axially retained by one wall of the groove 11 and by a spring ring, which is not shown in FIG. 1, and which is inserted in a further groove 12 in the hub 2 and overlies a small part of the sector plate 10. In order to ensure that the sector plate 10 is not rotatable relative to the hub 2, the sector plate is provided with two opposed cut-outs 13. Pins, which are inserted into corresponding borings 14 provided in the wall of the exhaust passage 1, (but which for reasons of clarity are, however, not shown in FIG. 1), engage in these cut-outs. In this or an equivalent manner, it is ensured that a part of the valve arrangement, i.e. the sector shutter 10, is non-rotatably and immovably positioned in the exhaust passage 1 and immediately follows in the same direction of rotation, and at the same speed, the propeller shaft.

The sector shutter 10 has two cut-out sectors 15, 16, the edges of which, together with the wall of the exhaust passage 1, leave open two outlet openings for the exhaust gas. Relative to the normal cross-section in the exhaust systems of boat motors, the cross-sectional constriction by the sector shutter 10 presents no problem.

The closure plate 20 has basically the same shape as the sector shutter 10, its outer diameter corresponds to the inner diameter of the exhaust passage 1 and it has two sectors 25, 26, which correspond in size to the sectors 15, 16 of the sector shutter 10. The closure plate 20 and the sector shutter 10 each have a central through-boring 27 or 17.

Symmetrically at both sides of the boring 27, the closure plate 20 is provided with two drive members 28, 29, which project from the edges of respective ones of the sectors 25, 26 from the plane of the closure plate 20. In the present embodiment, the drive members are flat-surfaced work material strips and their main plane extends perpendicular to the plane of the closure plate. An inclined position of the drive members and/or a scoop-like twisting are conceivable.

By means of a screw, a rivet 30 or the like, extending through the two central borings 17, 27, the closure plate 20 is connected to the sector plate 10 so as to be rotatable about the axis 3 of the exhaust passage. The rotation which is possible is limited by the drive members 28, 29, which, in the assembled condition (FIG. 1), extend through the sectors 15, 16 of the sector plate 10. In one end position of the valve arrangement, which is not shown in the drawings, the closure plate 20, with the exception of the drive members, is completely covered by the stationary parts of the sector shutter 10. The drive members 28, 29 each abut a respective edge of the sectors 15, 16, so that the exhaust gas can pass the sectors 15, 16.

Figure 2:
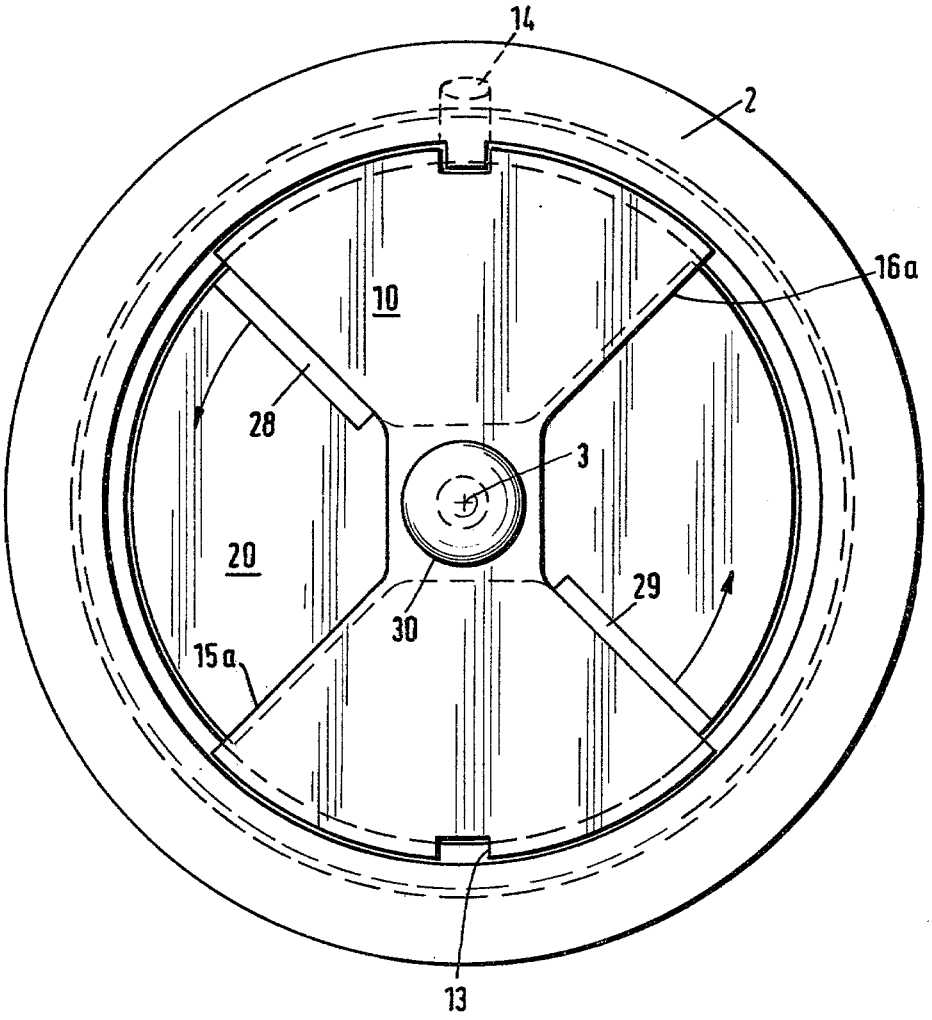
FIG. 2 shows a view in elevation of the open end of the passage shown in FIG. 1.

FIG. 2 shows, in contrast thereto, the other end or closed position of the valve arrangement. If the closure plate 20 is rotated in the direction of the arrow shown in FIG. 2, the sectors 15, 16 are increasingly opened and are fully open at the moment at which the drive members 28, 29 abut the other edges of the respective sectors 15, 16 and thus again determine the first end position of the valve arrangement, in which the exhaust gas can leave the exhaust system through the front opening 4 of the exhaust passage 1 or the hub 2.

On the other hand, the exhaust gas, when the valve arrangement is in the closed position shown in FIG. 2, escapes either through a pressure relief valve outside the vicinity of the propellor and/or through the compensating opening, which in any case is located in the motor shaft and/or through an annular gap 65 (FIG. 5) between the propeller and the motor shaft.

The above described valve arrangement operates as follows:

Firstly, let it be assumed that the propeller, during forward travel and viewed from the free front end of the propeller hub, rotates to the right (opposite to the arrow in FIG. 2) and that the drive members 28, 29 of the closure plate 20 are thereby moved against the left hand edges, in the direction of the propeller rotation, of their respective sectors 25, 26 (in the case of propellers rotating from the left, the drive members must be arranged at the respective opposite edges of their sectors).

When the propeller is stationary, the lower part of the exhaust system, including the exhaust passage 1, is filled with water, although even with the valve arrangement closed, the spacings provided there and in front of the propeller hub do not hinder, and also need not hinder, the throughflow of water. The drive members are consequently located in stationary water. As soon as the propeller shaft begins to rotate in the forward direction (to the right), the sector shutter 10 analogously begins to rotate therewith, since it is connected for rotation with the hub. The closure plate 22, on the other hand, is freely rotatably secured to the sector shutter 10 by the rivet 30. When the propeller begins to run, the closure plate tends to maintain its position relative to the water, since the drive members 28, 29 bear against the surrounding water. The consequence is that the closure plate will firstly follow the rotation of the propeller when the edges 15*a*, 16*a*, which are untouched in FIG. 2, of the sectors 15, 16 have engaged the drive members. In this way, the flow cross-section is opened. The exhaust gas in the system firstly conveys the water which is located in the system outwardly through the opening 4, and the exhaust gas, which in any case is constantly mixed with cooling water, follows. Due to the water present in the exhaust gas and the relative rotation between the exhaust gas column and the exhaust passage, the closure plate is retained in its opened position continuously during clockwise rotation of the propeller, so that the exhaust gas can flow outwardly unhindered and in the normal manner.

Upon a changeover to rearward travel, there is again so much water behind the propeller that the closure plate 20, through its drive members 28, 29, is again retained by the water while the sector shutter 10 begins its left-ward rotation, corresponding to the new direction of rotation of the propeller. Viewed relatively, the two drive members thus move into the closed position of the valve arrangement, shown in FIG. 2, and interrupt the exhaust gas flow through the opening 4. During rearward travel, the drive members agitate the water now located in front of them, but the consequently occuring power losses are negligible, since the drive members are, on the one hand, very small and arranged very close to the axis 3 and, on the other hand, located within the hub 2.

If the propeller is finally again changed over to forward travel, then the closure plate 20 with its drive members 28, 29 again tends to retain its position in space. The consequence is that the sector plate rotates relative to the closure plate 20 and again thereby opens the opening. In this case, therefore, the relative movement of the drive members 28, 29 indicated by the arrow in FIG. 2 again occurs.

Experiments have shown that the valve arrangement opens and closes even during idle rotation of the propeller.

As an alternative to the embodiment shown in the drawings, there is firstly conceivable a variant in which the valve arrangement is not incorporated in the region of the outlet opening 4 of the propeller hub but, in the direction of force transmission, before the propeller within the motor shaft. In this case, it is important to maintain the relative movability of the elements forming the valve arrangement and a drive member arrangement which is exposed to the water.

A slightly modified embodiment is shown in FIG. 5, in which the basic arrangement of a propeller 50 on a propeller shaft 51 and on the shaft 52 can be seen. The propeller shaft 51 is provided with a wedge toothing 53, which extends from the front free end to a shoulder 54 on the propeller shaft. At the shoulder 54, there is provided a thrust washer 55, which is provided with a boring having a wedge toothing.

The propeller 50 has, in the present embodiment, three blades 56, of which only one is visible and which extend substantially radially from the hub 2. The hub again defines the exhaust passage 1, and the end of the hub forms the exhaust gas opening 4. From the inner wall of the hub 2, four ribs 57 project radially towards the axis 3. They support a sleeve 58, which extends concentrically with respect to the propeller shaft, is supported at one end, i.e. the left hand end, against the thrust washer 55 taking up the forward propulsion and is extended radially inwardly at its other end. A centering sleeve 59, provided internally with a wedge toothing conforming to the propeller shaft, is slid onto the propeller shaft and connected to the aforementioned sleeve 58 by a rubber element 60. The rubber element 60 is secured by vulcanization or the like to the centering sleeve 59 and is pressed by radial force against the sleeve 58. The purpose of this arrangement is to provide a slipping clutch effect when one of the blades 56 of the propeller impacts against an obstruction.

The propeller shaft 51 is provided with a thread in the region of its free end. For taking up the rearward propulsion of the propeller 50, there is provided a further thrust washer 61, which at its interior has a shoulder with a running surface, by means of which it takes part in the centering of the propeller, since the inwardly extended part of the sleeve 58 can be supported on it. Radially outside the inwardly disposed projection, the thrust washer 61 has an end face by means of which it is supported in the axial direction against the inwardly extended part of the sleeve 58. When a stop nut is now threaded onto the propeller shaft from the free end of the propeller shaft, the stop nut presses the thrust washer 61 against the sleeve 58, and the sleeve 58 is in turn pressed against the front thrust washer 55, whereby the propeller is securely and rotationally fixedly connected to the propeller shaft 51. The construction, as thus far described, is conventional and has long been known.

Figure 4:
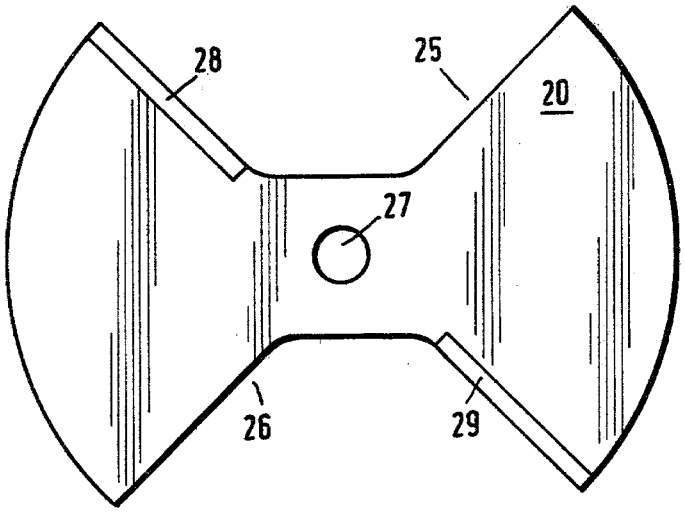
FIG. 4 shows a view in elevation of the associated moveable part of the valve arrangement.

As shown in FIG. 5, the valve arrangement in the present case again comprises the sector shutter 10 and the closure plate 20 with the drive members 28, 29. In contrast to the previously described embodiments, it is in this case provided that the closure plate 10 is either connected with the thrust washer 61 or is an integral component of this thrust washer 61 or itself simultaneously forms the thrust washer. Moreover, the thrust washer 61 has, radially outwardly of its first inwardly extending shoulder, a second such shoulder and is thus formed stepped at its side facing away from the stop nut 62. On the radially outermost step, the closure plate 20 can rotate freely within the range limited by the drive members 28, 29. In this case, the wedge toothing of the thrust washer 61 serves to rotationally fixedly secure the sector plate 10. The operation of this valve arrangement corresponds to the previously described operation. The shapes of the sector shutter 10 and the closure plate 20 correspond, in principle, to the shape shown in FIGS. 3 and 4. However, in this case, the cut-outs 13 are omitted from the sector shutter 10 and the boring 17 is replaced in this embodiment by the boring of the thrust washer 61. In the case of the closure plate 20, the boring 27 is made sufficiently large to be able to be fitted over the abovementioned shoulder on the thrust washer 61.

It is in addition to be understood that the valve arrangement provided at the outlet end of the hub 2 in FIG. 5 can alternatively be provided in a correspondingly similar manner at the inlet end of the hub, whereby the sector shutter 10 can suitably be connected with the thrust washer 55 located there.

Figure 6:
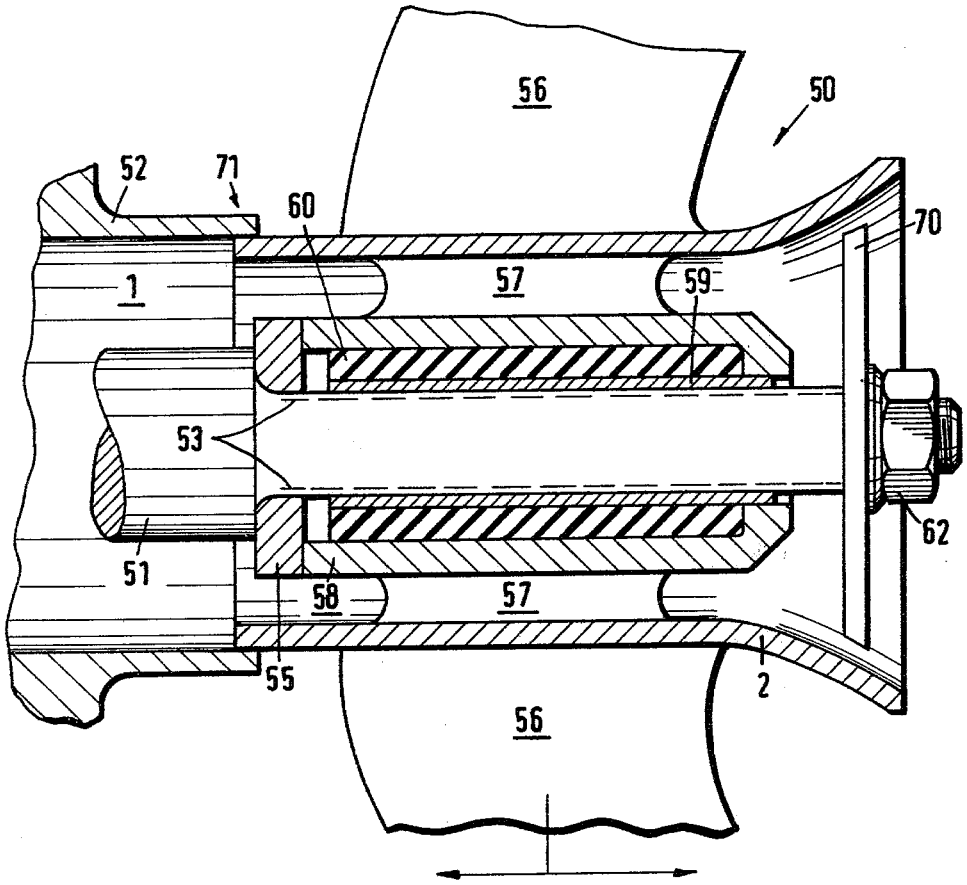
FIG. 6 shows a longitudinal section through a further embodiment of the invention.

In the embodiment illustrated in FIG. 6, in like manner only the lower end of the outboard motor is visible, with its shaft 52 through which extends the propeller shaft 51 which, in a manner not shown, is provided with a reverse gear and in many cases surrounds the exhaust passage 1 of the motor. A propeller 50 is fitted and secured on the end of the propeller shaft 51 projecting from the shaft 52.

The propeller 50 has a propeller hub 2, from which two or three blades 56 normally project for effecting propulsion and which continues the exhaust passage 1 along the propeller shaft 51 and has an opening 4, through which the exhaust gas can leave the outboard motor.

The propeller 50 further comprises a centering sleeve 59 provided with a wedge toothing, the sleeve 59 being slid over the propeller shaft 51, which is provided with a corresponding wedge toothing 53. Between the centering sleeve 59 and the hub 2, there is provided a further sleeve 58, which is secured to the centering sleeve 59 by means of a rubber element 60 of circular cross-section and which is carried thereby. Ribs 57, which for example extend in the direction of the axis 3 of the propeller shaft 51, serve as a connection between the further sleeve 58 and the hub 2, the ribs 57, as viewed in cross-section, leaving three openings therebetween for the exhaust gas. During forward travel, the propeller 50 transmits the forward propulsion through a thrust washer 55 or the like to the propeller shaft 51. This forward propulsion thus acts to the left. Furthermore, from the drawing it can be seen that the circularly formed hub 2 of the propeller, on abutment of the sleeve 58 against the thrust washer 55, engages to a small extent in the exhaust passage 1 of the shaft 2, so that between these two parts, in the position shown, no significant amount of exhaust gas can escape into the surrounding water.

On the free end of the propeller shaft 51, there is secured a disk 70, which rotates with the shaft. The small axial spacing between this disk 70 and the thrust washer 55 is larger than the axial length of the parts serving to secure the propeller 50 on the propeller shaft. The consequence of this is that the propeller is axially movable on the shaft between abutments formed by the thrust washer and the disk.

The relative position of the propeller, the propeller shaft and the motor shaft shown in the drawing corresponds to the forward propulsion condition. When the propeller shaft is reversed, the propeller produces a rearward propulsion, which firstly causes it to be moved axially, to the right, against the disk 70, before it can transmit the propulsion to the shaft and thereby to the motor. Because of this movement, an annular gap opens between the shaft 52 and the hub 2. Simultaneously, the opening 4 is closed by abutment of the disk 70 against the conically divergent wall of the hub 2. The gas coming from the exhaust passage 1 passes through this annular gap into the water, where it can no longer affect the efficiency of the propeller.

If the motor shaft 51 is again reversed, the propeller provides the required forward propulsion and consequently is thereby firstly moved along the shaft 51 into abutment with the thrust washer 55. The annular gap between the parts 52 and 2 is thereby again completely, or at least to a large extent, closed, so that the exhaust gas flows out through the opening 4 and the propeller again draws in the water without interference.

In the illustrated embodiment, the disk 70 has a diameter which enables it to completely close the opening 4 in one end position of the propeller. Experiments have shown that such closure is not absolutely necessary, and that moveover it is in most cases sufficient to form the annular gap between the parts 52 and 2. Due to the pressure relationships prevailing around the entire propeller hub, the exhaust gas then passes radially through the annular gap and not through the still open opening 4.

It is finally pointed out that the wedge toothing 53 may be spirally shaped and that the propeller shaft 51, both in the vicinity of the annular gap 71 and also in the vicinity of the plate 70, may be sealed by means of a bellows, or in a different manner, against the surrounding water, in order to prevent the entry of mud into the relatively displaceable parts.

It is also possible to fix the hub 2 immovably on the shaft and to make the shaft axially displaceable.

In the case of the embodiment shown in FIG. 6, the valve system is thus formed by the axially displaceable propeller in association with the stationary disk 70 and the annular gap 71.

In the embodiments of FIGS. 1 to 5, the valve system comprises the rotary valve arrangement comprising the plate 20 and the sector plate 10 in association with the annular gap 65 (FIG. 5) and/or with the outlet openings, which are not shown, in the shaft 52 of the boat motor.

In all of these embodiments, the valve system is automatically changed over to the opened position during forward travel and into the closed position during rearward travel by the rotation of the propeller and in the closed condition the exhaust gas flows from the exhaust system at a position at which it cannot reach the suction zone of the rotating propeller.

I claim:

1. Apparatus for increasing the rearward propulsion of boat motors provided with reverse gears, an exhaust system, and a propeller having a hub, in which an axially directed exhaust passage extends through the propeller hub and in which the exhaust system has an equalization opening disposed outside the vicinity of the propeller hub, said apparatus further including a valve means disposed within said exhaust passage and being movable between a closed position, in which exhaust gas flow through said passage is interrupted and an open position, in which at least a substantial part of the cross-section of the exhaust passage is opened, and further including means independent of said propeller and said hub and operably connected directly to said valve means for selectively opening and closing said valve means responsive to a changing of direction of rotation of the propeller, said opening and closing means being disposed in a position exposing same to water adjacent said hub.

2. Apparatus according to claim 1, characterized in that the valve means is constructed as a rotary valve and the elements forming the rotary valve are rotatable about an axis (3) on which the propeller shaft lies.

3. Apparatus according to claim 2, characterized in that the valve means comprises a sector shutter (10) provided with cut-out sectors (15, 16) and a closure plate (20), provided with corresponding cut-out sectors (25, 26), and further includes at least one drive member attached to said closure plate and comprising said opening and closing means.

4. Apparatus according to claim 3, characterized in that the sector shutter (10) is fixedly connected with respect to one of the propeller shaft and an element rotationally fixedly connected with it, and the closure plate (20) is rotatable about said axis (3), and is rotatably secured to the sector shutter (10).

5. Apparatus according to claim 4, characterized in that at the closure plate (20), at least one drive member is connected thereto adjacent each sector (25, 26) therein.

6. Apparatus according to claim 5, characterized in that said drive members (28, 29) are disposed substantially perpendicular to the plane of the closure plate (20).

7. Apparatus as in claim 3, characterized in that each drive member is angled, from the plane of the element of said closure plate in the direction of the axis (3).

8. Apparatus as in claim 3, characterized in that said drive member extends from said closure plate through a sector in said sector shutter.

9. Apparatus according to claim 8, characterized in that said drive member protrudes from the closure plate (20) through the sectors (15, 16) of the sector shutter (10), and engages said sector shutter to stop rotation of said closure plate in one of said closed and open positions.

10. Apparatus according to claim 3, characterized in that the sector shutter (10) includes and axially directed projection having a peripheral surface, extending coaxially with respect to said axis as a running surface for the closure plate (20) and that this projection has, in the axial direction, a length equal to or greater than the thickness of the closure plate (20).

11. Apparatus according to claim 10, characterized in that the sector shutter (10) comprises a thrust washer means for fixing the propeller on the propeller shaft (51).

12. Apparatus according to claim 10 or 11, wherein said sector shutter includes a bore therethrough and characterized in that the bore (17) of the sector shutter (10) is provided with a wedge toothing corresponding to the propeller shaft (51).

13. In apparatus for increasing rearward propulsion of a marine drive unit through ambient water, including a housing, a motor, an exhaust system, forward and reverse gears, a propeller drive shaft and a propeller having a hub, wherein said exhaust system includes an equalization opening spaced from said propeller hub, and an exhaust passage in said hub having a rearwardly disposed outlet with respect to a forward direction of motion of said drive unit, and valve means disposed within said exhaust passage and movable between an open position, passing exhaust from said outlet, and a closed position, blocking said outlet, an improvement in said apparatus including:

drive means connected to said valve means and independent of said propeller and of said hub for selectively driving said valve means between said open and closed positions.

14. Apparatus according to claim 13, wherein said drive means is exposed to ambient water within said hub.

15. Apparatus according to claim 13, wherein said valve means comprises a rotary valve having at least a rotatable member.

16. Apparatus according to claim 15, wherein said valve means includes a shutter member secured to one of said propeller drive shaft and said hub, against rotation with respect thereto, said shutter member having exhaust flow openings therein, and said valve means further including a closure plate having exhaust flow openings therein and rotatably mounted with respect to said shutter member.

17. Apparatus according to claim 16, wherein said closure plate and said shutter member are movable with respect to each other between an open position wherein said respective flow openings are aligned and a closed position wherein the respective flow openings are blocked.

18. Apparatus according to claim 17, wherein said drive means includes a water engaging drive member secured to said closure plate for driving it between said open and closed positions in response to changes in direction of rotation of said propeller.

19. Apparatus according to claim 18, wherein said drive member extends from said closure plate through a flow opening in said shutter member and rearwardly thereof.

20. Apparatus according to claim 19, wherein said drive member engages edges of said flow openings, defining limits of motion of said closure plate in said open and closed positions.

21. Apparatus according to claim 16, wherein said shutter member is secured to said hub and said closure plate is rotationally pinned to said shutter member.

22. Apparatus according to claim 16, wherein said shutter member is secured to said drive shaft and includes an axially extending cylindrical boss defining a circumferential bearing surface, said closure plate having a bore mounted about said bearing surface, and said bearing surface being at least as thick, in an axial direction, as said closure plate.

23. Apparatus according to claim 22, wherein said shutter member and said boss comprise a thrust washer means for securing said propeller on said drive shaft.

24. In apparatus for controlling exhaust flow from a marine propulsion unit having an engine, a propeller drive shaft connected thereto, a propeller and propeller hub mounted on said drive shaft, an exhaust flow system including an exhaust outlet passage in said hub, and means for driving the drive shaft and propeller in opposite directions of rotation for forward and rearward motion through ambient water, the improvement including:

valve means disposed within said hub for selectively blocking and opening said exhaust outlet passage in response to the direction of rotation of said propeller and hub, and valve operating means independent of and movable with respect to said propeller for opening and closing said valve means in response to direction of rotation of said propeller.

25. Apparatus according to claim 24, wherein said valve operating means includes a drive member operably connected to said valve means and disposed in engagement with said ambient water for closing and opening said valve means responsive to direction of rotation of said propeller and to said engagement of said water.

* * * * *